US008800193B1

(12) United States Patent
Frear, Jr.

(10) Patent No.: US 8,800,193 B1
(45) Date of Patent: Aug. 12, 2014

(54) BUSHING WRENCH

(75) Inventor: Walter F. Frear, Jr., Monrovia, MD (US)

(73) Assignee: W. Frear Innovations LLC, Monrovia, MD (US)

( * ) Notice: Subject to any disclaimer, the term of this patent is extended or adjusted under 35 U.S.C. 154(b) by 0 days.

(21) Appl. No.: 13/451,147

(22) Filed: Apr. 19, 2012

Related U.S. Application Data

(60) Provisional application No. 61/476,781, filed on Apr. 19, 2011.

(51) Int. Cl.
*F41C 27/00* (2006.01)

(52) U.S. Cl.
USPC ..... 42/108

(58) Field of Classification Search
USPC ..... 42/108, 70.11, 106; 81/3.05, 58, 109, 81/99, 475, 478, 472, 3.44, 3.29, 63.2
See application file for complete search history.

(56) References Cited

U.S. PATENT DOCUMENTS

| | | | | |
|---|---|---|---|---|
| 4,483,060 | A | 11/1984 | Farrar et al. | |
| 4,901,411 | A * | 2/1990 | Chestnut et al. | 42/108 |
| D407,958 | S * | 4/1999 | Royse, III | D8/16 |
| 6,430,862 | B1 | 8/2002 | Berlin | |
| 6,904,634 | B2 | 6/2005 | Smith | |
| 6,918,323 | B2 * | 7/2005 | Arnold et al. | 81/63.2 |
| 7,174,667 | B2 | 2/2007 | Connal | |
| 7,240,450 | B2 | 7/2007 | Shober | |
| 7,401,432 | B2 | 7/2008 | Perry | |
| D603,233 | S | 11/2009 | Beckham | |
| 2005/0071925 | A1 * | 4/2005 | Smith | 7/128 |
| 2006/0162224 | A1 * | 7/2006 | Connal | 42/108 |
| 2006/0260170 | A1 * | 11/2006 | Perry | 42/108 |
| 2007/0034058 | A1 * | 2/2007 | Chen | 81/58 |
| 2010/0095576 | A1 * | 4/2010 | Johns | 42/108 |

* cited by examiner

*Primary Examiner* — Samir Abdosh
*Assistant Examiner* — John D Cooper
(74) *Attorney, Agent, or Firm* — Malcolm J. MacDonald

(57) ABSTRACT

A bushing wrench for a pistol, the bushing wrench having a reciprocating ejection plunger, which facilitates the installation and removal of a recoil spring plunger in a controlled and properly timed manner by way of a receiving and ejection position.

18 Claims, 12 Drawing Sheets

BUSHING WRENCH

This application claims priority to U.S. Provisional Application No. 61/476,781, filed on Apr. 19, 2011, the contents of which are incorporated herein by reference.

FIELD OF THE INVENTION

The invention relates to a bushing wrench used for the simultaneous removal and installation of a barrel bushing for a 1911-style pistol.

BACKGROUND OF THE INVENTION

A Colt 1911 semi-automatic pistol (partially illustrated in FIGS. 5 to 10), and its clones, utilize a barrel bushing (8) which is rotatably affixed in pistol slide (10). The purpose of the barrel bushing (8) is to retain and align the pistol's barrel (9), recoil spring and spring plunger (7) inside the pistol's slide (10) to facilitate correct operation of this pistol type. When this type of handgun is in need of repair and/or cleaning service, the barrel bushing (8) requires removal in order that the barrel (9) and subsequent components of the pistol may be disassembled.

In order to effectively remove and subsequently reinstall the barrel bushing (8), recoil spring and spring plunger (7), the operator uses a bushing wrench to remove the barrel bushing (8).

The following U.S. Patents, which are herein incorporated by reference, describe and illustrate existing bushing wrenches: U.S. Pat. No. 7,401,432; U.S. Pat. No. 7,240,450; U.S. Pat. No. 7,174,667; U.S. Pat. No. 6,904,634; U.S. Pat. No. 6,430,862; U.S. Pat. No. 4,901,411; U.S. Pat. No. 4,483,060; U.S. D407,958; and U.S. D603,233.

U.S. Pat. No. 4,901,411 describes a tool for the partial disassembly of a firearm, and in particular to a tool for rotating and/or removing a pistol barrel bushing or plug.

Conventional style barrel bushing wrenches do not incorporate the retention and controlled delivery of the recoil spring and spring plunger (7) during the time of unlocking or locking of the barrel bushing (8) (FIGS. 5 and 6), resulting in unwanted lack of control of the disassembly of the firearm.

The operator is required to manipulate their off-hand and fingers at the time of locking or unlocking of the barrel bushing (8), so that the recoil spring and spring plunger (7) are placed in their desired position with respect to barrel bushing (8) and pistol slide (10).

The receiving recess (12) allows the bushing wrench (1), and operator, to establish and maintain greater control over the removal and installation of spring plunger (7) by means of fully enclosed surface contact to the tip of spring plunger (7), thus providing radial and axial containment when linear compression is given to spring plunger (7).

Full containment of spring plunger (7) is only permissible because the bushing wrench (1) of the invention is equipped with the means of releasing spring plunger (7) by way of reciprocating ejection plunger assembly (3, 4, 5) being selectively activated when time of release is deemed necessary by bushing wrench (1) operator.

A bushing wrench has not heretofore particularly lent itself to ease of operation and, in particular, the increased safety aspects afforded by the present invention during operation of a pistol.

DETAILED DESCRIPTION OF THE INVENTION

Figure 1:
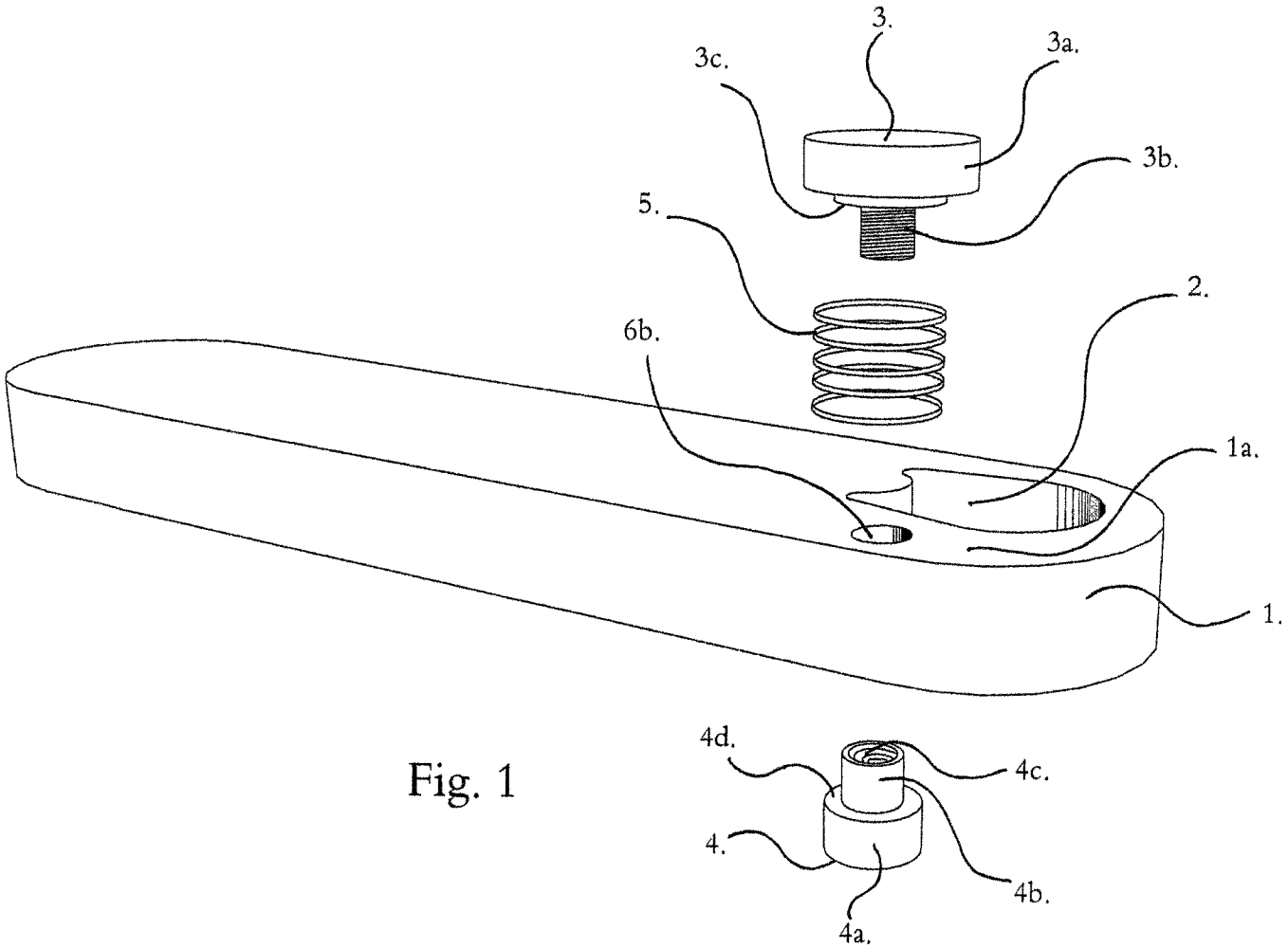
FIG. 1 shows an exploded perspective view of the bushing wrench with reciprocating ejection plunger assembly disassembled.
Figure 5:
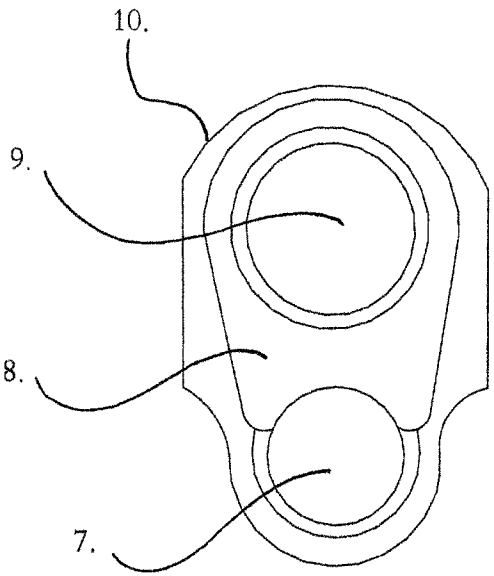
FIG. 5 shows a front perspective view of pistol slide with barrel bushing in locked position.

Referring now to the Figures, which show the preferred embodiments of the invention, the device of the invention is a bushing wrench (1) used for the simultaneous removal and installation of a 1911-style barrel bushing (8), recoil spring and spring plunger (7) by way of compression of the spring and spring plunger (7) and rotation of the barrel bushing (8) (FIG. 1). This bushing wrench (1) utilizes an opening (2) that accommodates the outer periphery of a common barrel bushing (8) (FIG. 5).

The main body of the bushing wrench (1) is preferably manufactured from materials such as bar stock aluminum alloy, steel or a rigid plastic polymer. The rendering of the material to its desired configuration can be accomplished using conventional stock removal techniques with the utilization of CNC machining. Additionally, a polymer injection mold could be established to create the main body of bushing wrench (1) in polymeric form, if so desired. The bushing wrench may also be manufactured from a ceramic material.

The reciprocating ejection plunger assembly (FIGS. 1 to 4) comprises three components (3, 4, 5). In FIG. 1, actuator pad (3) is shown with male screw threads (3*b*) exposed, ejection plunger (4) is shown with female threads (4*c*) exposed, and upper circular bore portion (6*b*) is shown.

The ejection plunger (4) comprises a lower cylindrical portion (4*a*) having a diameter, and an upper cylindrical portion (4*b*) having a diameter that is smaller than the diameter of the lower cylindrical portion (4*a*). The ejection plunger (4) may be manufactured from materials such as aluminum, steel, ceramic, or plastic. The ejection plunger (4) may be manufactured by means of stock removal using a turning lathe. The center of the upper portion (4*b*) of the plunger head (4) is tap-threaded (4*c*) for female threads along its linear axis. The depth of the tap-thread (4*c*) is slightly greater than the length of threaded portion (3*b*) of actuator pad (3), to allow the plunger actuator pad (3) to be rotatably fastened thereon when the ejection plunger assembly (3, 4, 5) is mounted to the body of the wrench (1). The actuator pad (3) may also be securely fastened to the ejection plunger (4) by any other means which will ensure the fastening together of these two components.

The three sub-components are assembled into, and behind wrench (1). The lower cylindrical portion (4*a*) of ejector plunger (4) is disposed within lower circular bore portion (6*a*) when the ejection plunger assembly is mounted on the wrench (1).

The plunger actuator pad (3) is a machine-threaded screw shaft with a cap (3*a*) affixed to or part of one end of the screw threaded portion (3*b*). This cap (3*a*) is of a size and shape suitable to be engaged by the index finger or thumb of the operator, such that when pressed downwardly, will facilitate the ejection of spring plunger (7) from receiving recess (12).

Figure 3:
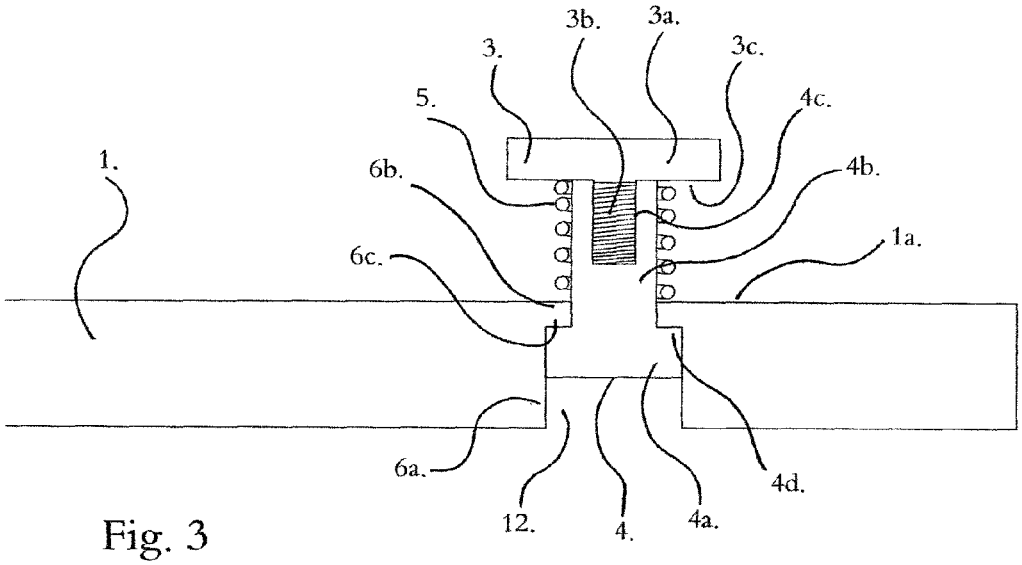
FIG. 3 shows a cross sectional cutaway of ejection plunger assembly with the ejection plunger at the "receiving position".

The ejection plunger spring (5) is of conventional coil spring steel, suitable for the size and weight of application for retraction of the reciprocating ejection plunger assembly (3, 4, 5) to its "receiving position" (FIG. 3; elements 3, 4, 5).

The bushing wrench (1) is manufactured with a dimension which is two to three times thicker than that of wrenches currently in use today. The thickness of the bushing wrench is sufficient to accommodate reciprocating ejection plunger assembly (3, 4, 5), and in particular ejection plunger (4).

The ejection plunger spring (5) when assembled to the wrench is captured between surface (1*a*) of bushing wrench (1) and the lower surface (3*c*) of actuator pad (3) (FIGS. 1 to 4, and 8).

The reciprocating ejection plunger (4) is housed within a circular bore (6) extending through the bushing wrench (1) proximate to bushing opening (2). Circular bore (6) comprises a lower circular bore portion (6*a*) having a diameter, and an upper circular bore portion (6*b*) having a diameter that is smaller than the diameter of the lower circular bore portion (6*a*). The upper extent of lower circular bore portion (6*a*) terminates in and is bounded by annular retention shoulder (6*c*), such that the upper circular bore portion (6*b*) extends upwardly from the centre of retention shoulder (6*c*).

Figure 2:
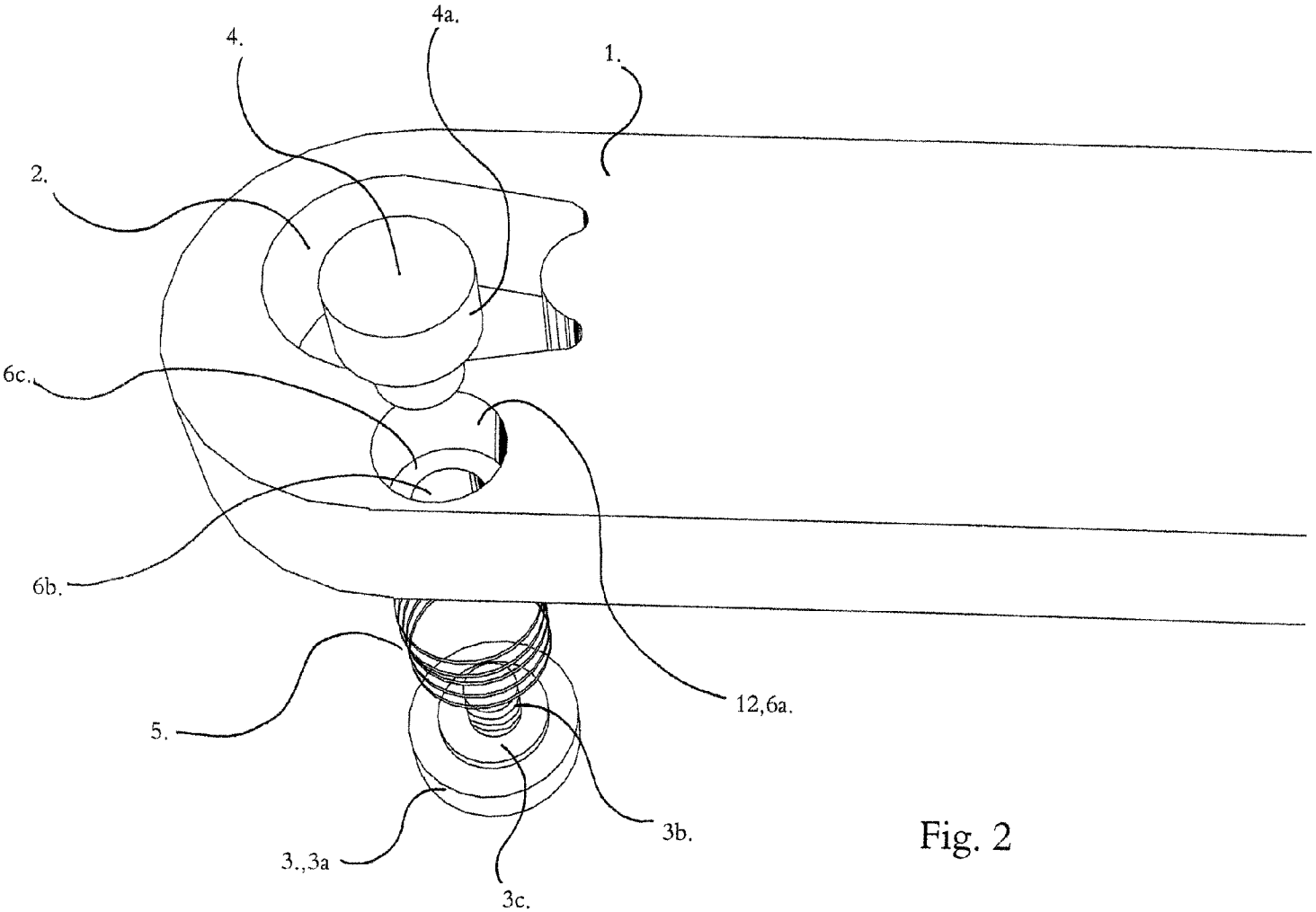
FIG. 2 shows an exploded view of bushing wrench.
Figure 4:
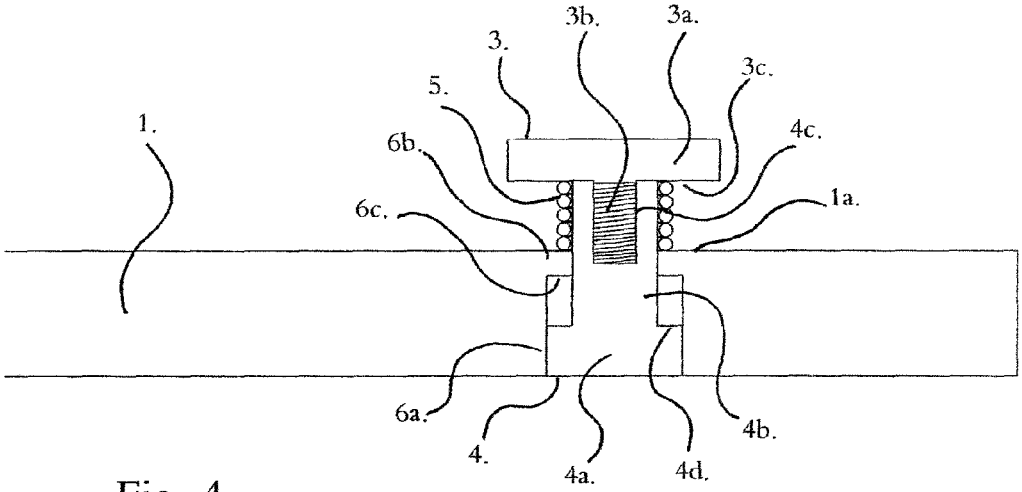
FIG. 4 shows a cross sectional cutaway of ejection plunger assembly with the ejection plunger at the "ejection position".

As can be seen from FIGS. 2-4 in particular, when the ejection plunger assembly is mounted in the wrench (1), lower circular bore portion (6*a*) accommodates the lower cylindrical portion (4*a*) of the ejection plunger (4). It will be apparent to those skilled in the art, therefore, that the maximum outside diameter of the lower cylindrical portion (4*a*) of the ejection plunger is fractionally less than the minimum diameter of the lower circular bore portion (6*a*), to allow the lower cylindrical portion (4*a*) to be received in the lower circular bore portion (6*a*).

Noting in particular FIG. 3, the reciprocating ejection plunger assembly (3, 4, 5) when retracted rearward to its "receiving position" by the biasing caused by coil spring (5) being in a decompressed state, provides a receiving recess (12), due to the fact that the thickness of the wrench is greater than the overall length of reciprocating ejection plunger (4).

When the biasing spring is compressed by the user, the reciprocating ejection plunger assembly (3, 4, 5) is moving forward to its "ejection position" (FIG. 4).

The receiving recess (12) will receive the tip of recoil spring plunger (7) of the pistol at the time that bushing wrench (1) rotates barrel bushing (8) to its unlocked position (FIGS. 6 and 8), allowing the release and decompression of spring plunger (7).

Referring now to FIGS. 3 and 4, it can be seen that the face of the retention shoulder (6*c*) is the rearward stopping point for ejection plunger (4), as the face (4*d*) of the lower cylindrical portion (4*a*) abuts the face of the retention shoulder (6*c*).

When the ejection plunger assembly is mounted in the wrench (1), upper circular bore portion (6*b*) accommodates the upper cylindrical portion (4*b*) of the ejection plunger (4). It will be apparent to those skilled in the art, therefore, that the maximum outside diameter of the upper cylindrical portion (4*b*) of the ejection plunger (4) is fractionally less than the minimum diameter of the upper circular bore portion (6*b*), to allow the upper cylindrical portion (4*b*) to be received in the upper circular bore portion (6*b*).

When the ejection plunger assembly is mounted in the wrench (1), actuator pad (3) is rotatably, removably, and threadably fastened to the upper cylindrical portion (4*b*) of the ejection plunger (4), by means of threaded portions (3*b* and 4*c*). Threaded portion (3*b*), which passes through upper cylindrical bore portion (6*b*) and engages threaded portion (4*c*) of the upper cylindrical portion (4*b*) of ejection plunger (4).

It will be appreciated that the depth of the upper circular bore portion (6*b*) is less than the length of the upper cylindrical portion (4*b*) of the plunger (4).

The depth of the lower circular bore portion (6*a*) will, however, be greater than the length of the lower cylindrical portion (4*a*) of the ejection plunger (4), such that when the ejection plunger assembly (3, 4, 5) is mounted in the wrench (1) with the biasing spring (5) installed between the lower surface (3*c*) of the actuator pad (3) and the upper surface (1*a*) of the wrench (1), the positive force exerted by the spring will force the actuator pad cap (3*a*) away from the surface (1*a*) of the wrench, and will cause a receiving recess (12) to be formed in the lower portion of the lower circular bore portion (6*a*). This receiving recess (12) receives the terminal portion of the spring plunger (7) of the pistol during disassembly of the 1911-style barrel bushing (8), recoil spring, and spring plunger (7).

It will be appreciated that the ejection plunger (3, 4) may be assembled on the wrench (1) without the plunger spring (5) present, and that the wrench will still function as a bushing wrench. However, without the plunger spring (5) present when the ejection plunger (4) is assembled on the wrench (1), ejection plunger (4) will free float without the presence of spring (5) until spring plunger (7) is released and subsequent decompression of (7) will move ejector plunger (4) to its "receiving position" and create receiving recess (12).

It should be noted that the receiving recess (12) allows the bushing wrench (1) to establish and maintain greater control over the removal and installation of spring plunger (7) by means of fully enclosed surface contact to the terminal portion of spring plunger (7), thus providing radial and axial containment when linear compression is given to spring plunger (7).

Full containment of spring plunger (7) is only permissible because bushing wrench (1) is equipped with the means of releasing spring plunger (7) by way of reciprocating ejection plunger assembly (3, 4, 5) being selectively activated when time of release is deemed necessary by bushing wrench (1) operator.

FIG. 5 shows a front perspective view of pistol slide (10), and its components (7, 8, 9) with barrel bushing (8) in locked position and spring plunger (7) in its assembled and retained position.

Figure 6:
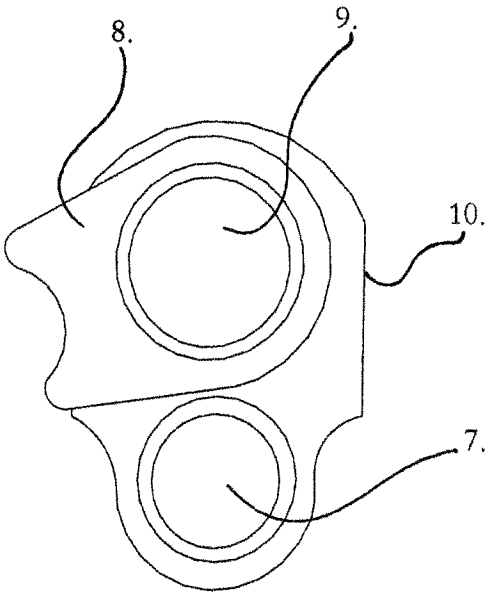
FIG. 6 shows a front perspective view of pistol slide with barrel bushing in un-locked position.

FIG. 6 shows a front perspective view of pistol slide (10), barrel (9), spring plunger (7), and barrel bushing (8) with bushing (8) in un-locked position.

Figure 7:
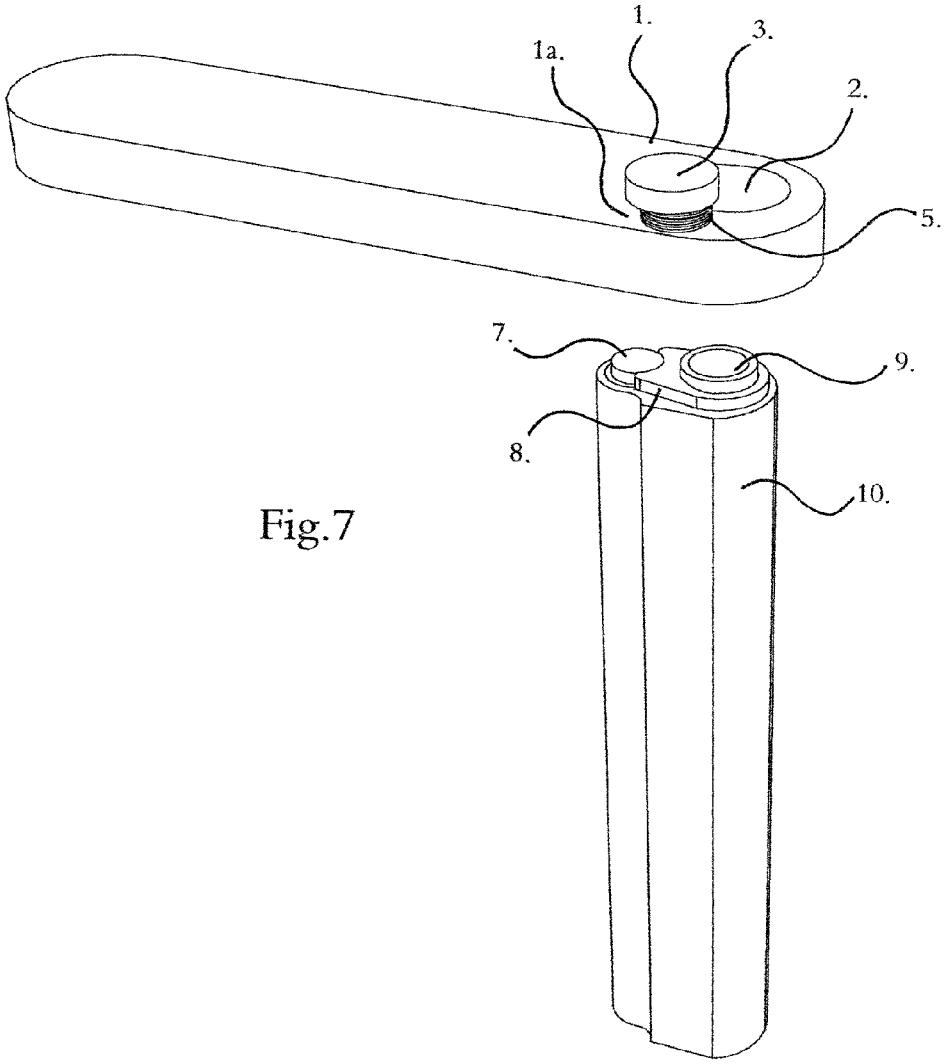
FIG. 7 shows a rear perspective view of the bushing wrench vertically aligned with pistol slide with barrel bushing in locked position.

FIG. 7 shows a rear perspective view of the bushing wrench vertically aligned with pistol slide (10) and components (7, 8, 9), with barrel bushing (8) in a closed position.

Figure 8:
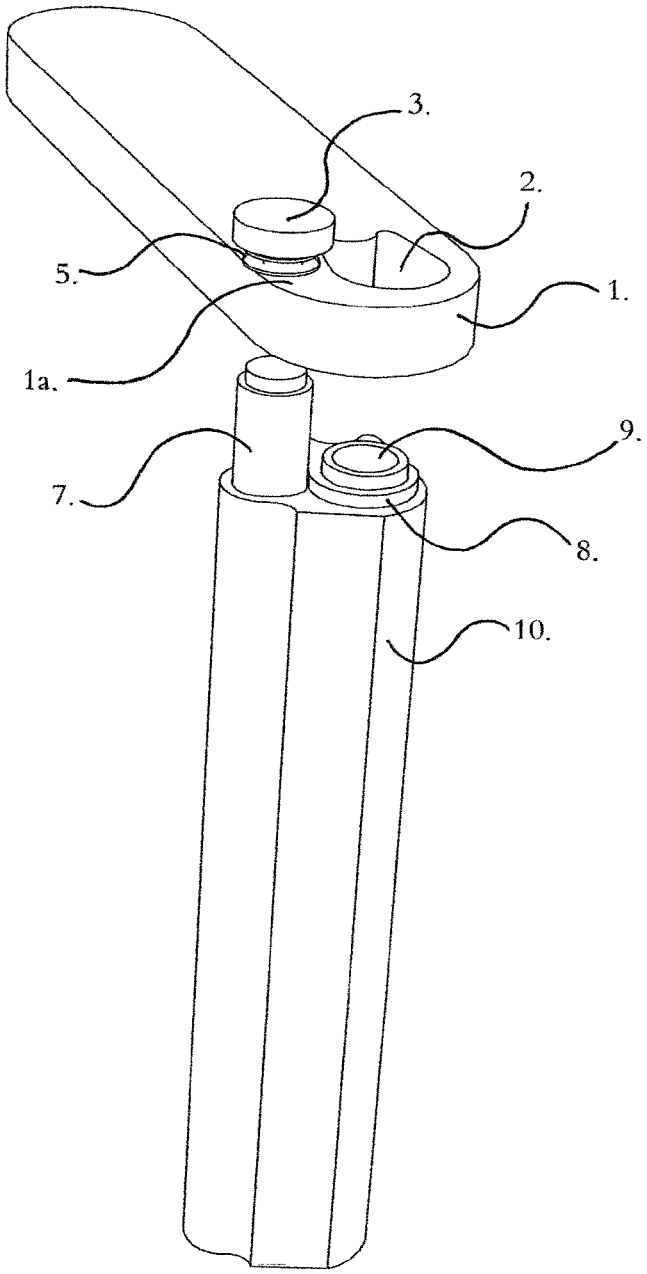
FIG. 8 shows a rear perspective view of the bushing wrench vertically aligned with pistol slide with barrel bushing unlocked and spring plunger protruding from slide.

FIG. 8 shows a rear perspective view of the bushing wrench vertically aligned with pistol slide (10) with barrel bushing (8) unlocked and spring plunger (7) protruding from slide (10) in a disassembled state.

Figure 9:
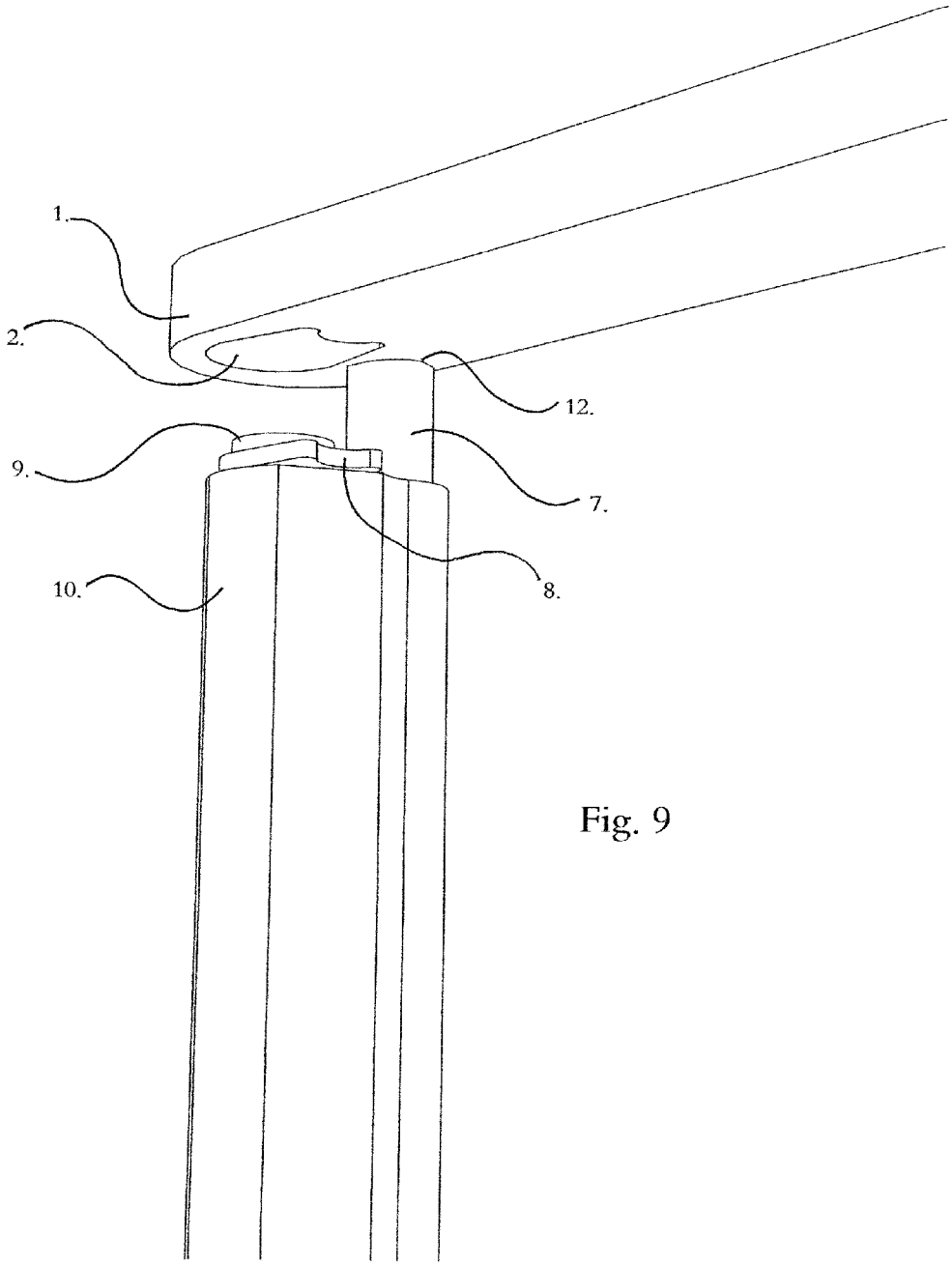
FIG. 9 shows a front perspective view of the bushing wrench with the terminal portion of spring plunger engaged in receiving recess.

FIG. 9 shows a front perspective view of the bushing wrench, as in FIG. 8, with front view of bushing wrench (1) and terminal portion of spring plunger (7) contained within receiving recess (12).

Figure 10:
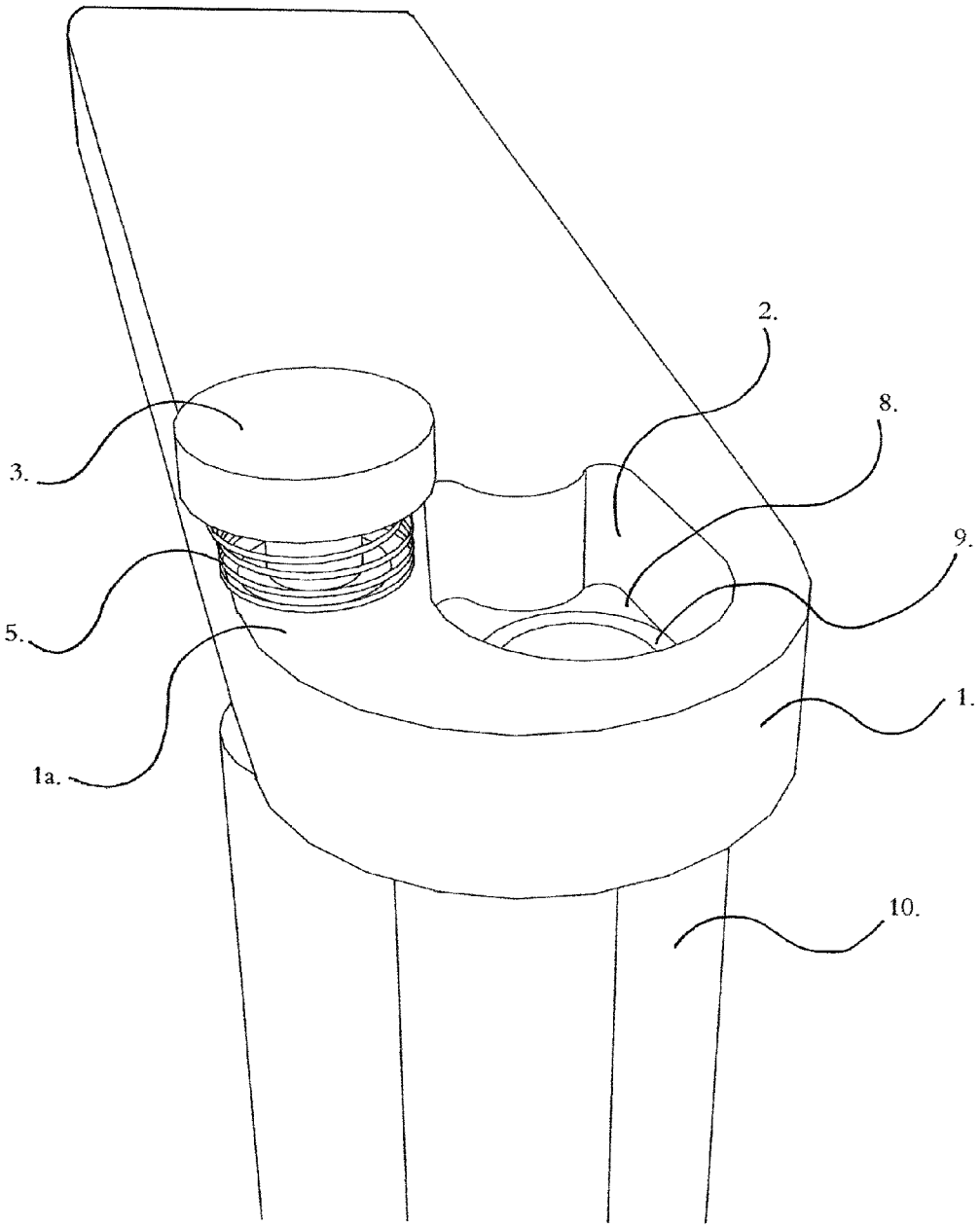
FIG. 10 shows a perspective view of the bushing wrench engaged to face of pistol slide.

FIG. 10 shows a perspective view of the bushing wrench engaged to face of pistol slide (10), with wrench opening (2) around barrel bushing (8). Barrel Bushing (8) in unlocked position (cf. FIG. 6), with spring plunger (7) compressed into pistol slide (10) and terminal portion of spring plunger (7) contained in receiving recess (12).

Figure 11:
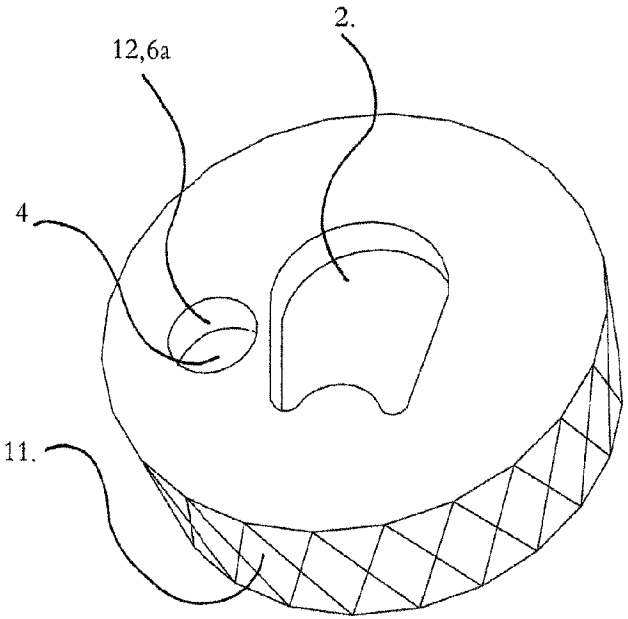
FIG. 11 shows a front perspective view of the second embodiment of the bushing wrench, with ejection plunger assembly installed and plunger at receiving position.

FIG. 11 shows a front perspective view of a second embodiment of the bushing wrench, with ejection plunger assembly (3, 4, 5). A textured (knurled) surface (11) is present around the outer circumferential edge of wrench, to assist the operator in gripping and/or turning the wrench. FIG. 11 shows a front view of the second embodiment of the bushing wrench ejection plunger assembly (3, 4, 5) installed in bushing wrench (1), with ejection plunger assembly (3, 4, 5) in "receiving" position.

Figure 12:
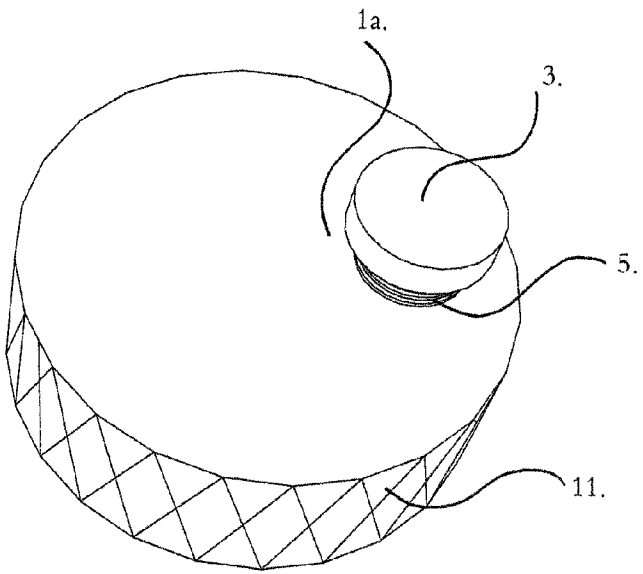
FIG. 12 shows a rear perspective view of a second embodiment of the bushing wrench with ejection plunger assembly installed.

FIG. 12 shows a rear perspective view of the second embodiment of the bushing wrench, ejection plunger assembly (3, 4, 5) installed in bushing wrench (1), with ejection plunger assembly (3, 4, 5) in "receiving position".

FIGS. 13 to 17 show a third and preferred embodiment of the wrench. The components of the third embodiment of the invention are manufactured from materials according to the description set forth above for the first and second embodiment of the invention shown in FIGS. 1 to 12, wherein like reference numerals are used for the third embodiment of the invention shown in FIGS. 13 to 17.

Figure 13:
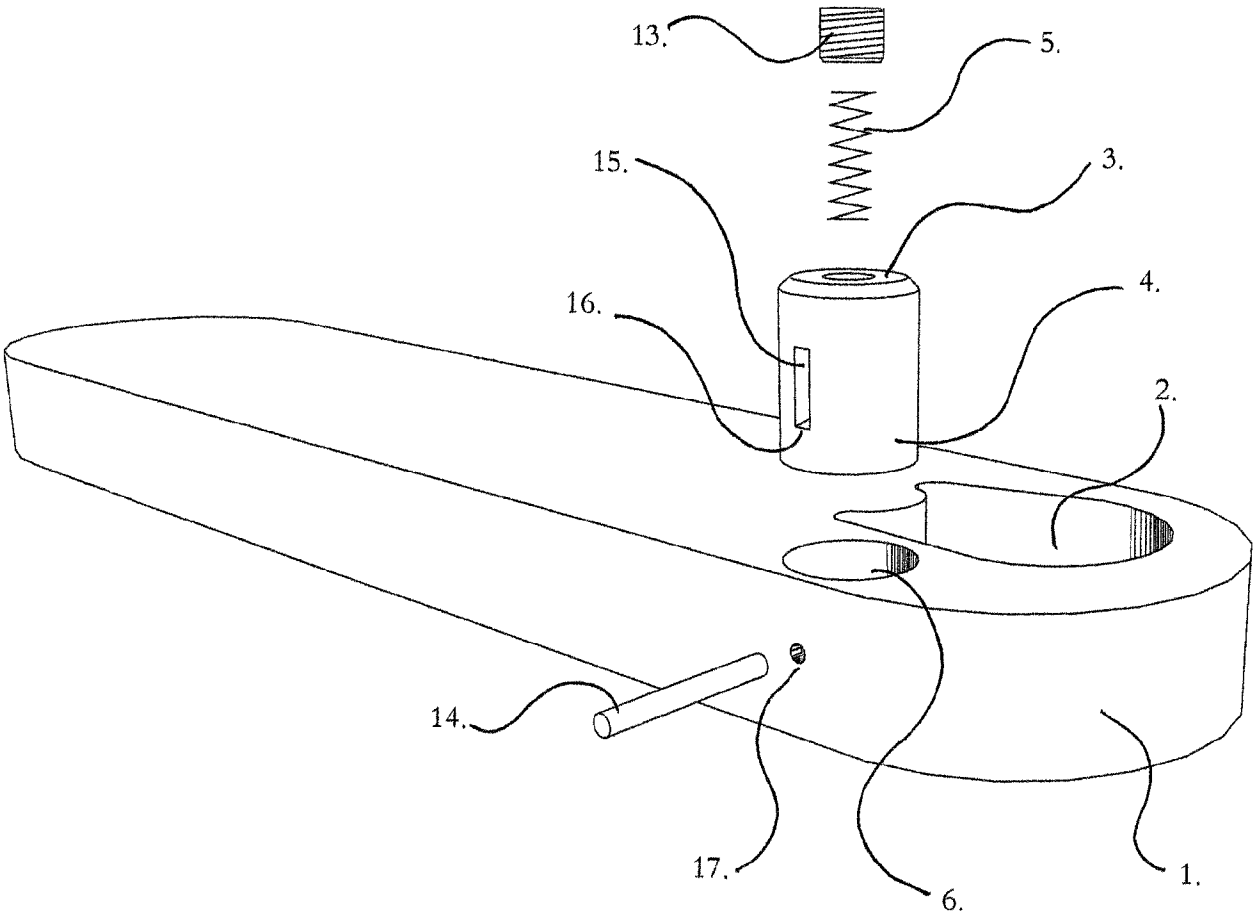
FIG. 13 shows an exploded view rear position of third embodiment with reciprocating ejection plunger assembly disassembled.
Figure 14:
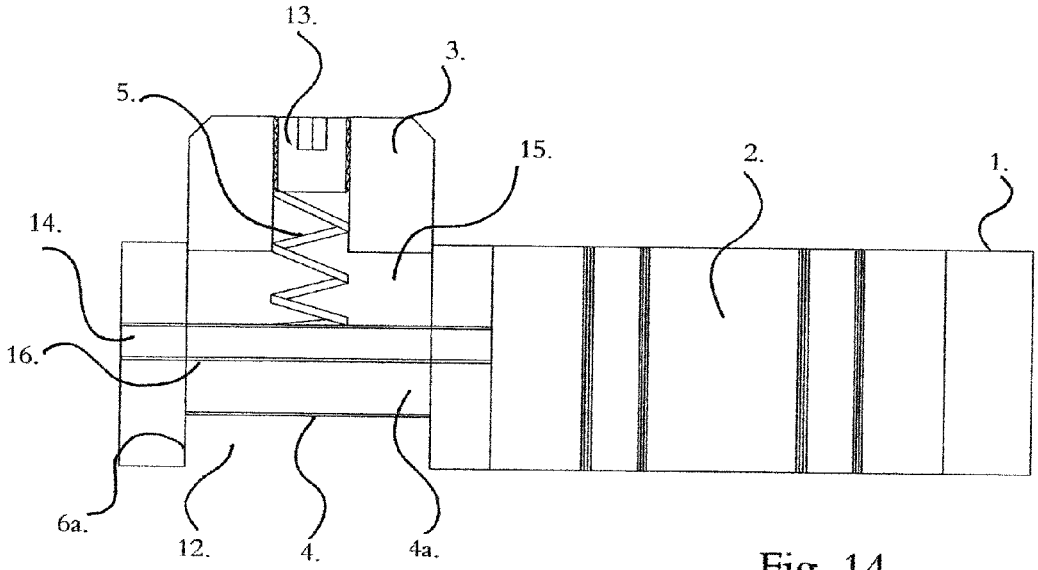
FIG. 14 shows a cross sectional view of the third embodiment of wrench with ejection plunger in "receiving position".

As seen in FIG. 13, the actuator pad (3) is manufactured as a single component of the ejector plunger assembly (3, 4). Plunger assembly (3, 4) is retained by retention pin (14) inserted perpendicular to liner axis of plunger assembly (3, 4), passing through plunger retention channel (15), which has a slot-like opening to allow the plunger assembly to move in an upward and downward manner. Plunger spring (5) operates to create a bias to maintain the ejection plunger in the "receiving position" when no force is exerted on the plunger assembly by the user, essentially as described for the first embodiment of the invention.

Figure 15:
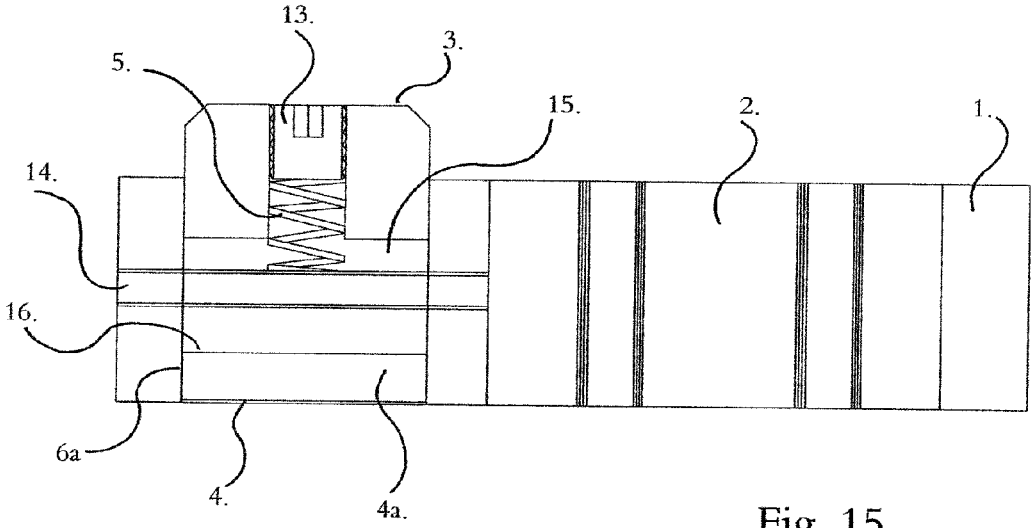
FIG. 15 shows a cross sectional view of the third embodiment of wrench with ejection plunger in "ejection position".

Circular bore (6) is of a straight walled dimension to accommodate linear movement of the straight wall cylinder shape of ejection plunger (3, 4). Retention screw (13) in addition to retaining plunger spring (5) serves to adjust the travel depth of ejection plunger assembly (3, 4, 5, 13, 15, 16). This adjustment allows the manufacture or user to fine tune the linear travel of the ejection plunger assembly (3, 4, 5, 13, 15, 16) so as to establish the precise point that the bottom of ejection plunger (4*a*) is flush with the front face of wrench (1). Establishing a flat plain surface between the wrench (1) face and ejection plunger (4*a*) maximizes the efficient release and subsequent rotatable performance of wrench (1) at the "ejecting position" (FIG. 15).

Figure 16:
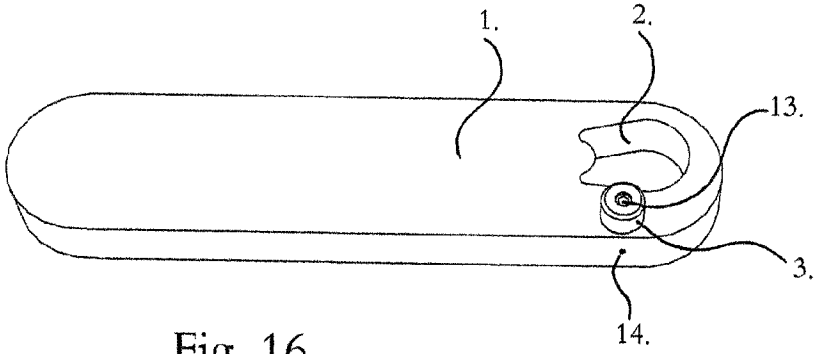
FIG. 16 shows a rear view of the third embodiment of the wrench with ejection plunger assembly installed and at "receiving position" in wrench.

FIG. 16 shows a rear view of the third embodiment of the wrench with ejection plunger assembly (3, 4, 5, 13, 14, 15, 16) installed and at "receiving position" in wrench (1).

Figure 17:
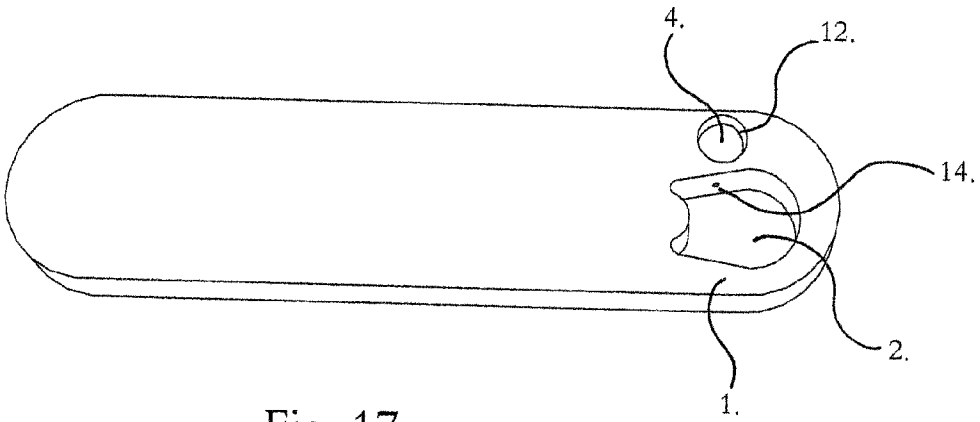
FIG. 17 shows a front view of the third embodiment of the wrench with ejection plunger assembly at the "receiving position" in wrench.

FIG. 17 shows a front view of the third embodiment of the wrench with ejection plunger assembly (3, 4, 5, 13, 14, 15, 16) installed and at "receiving position" in wrench (1).

The implementation of said reciprocating ejection plunger assembly (3, 4, 5) in the design of wrench (1) is what makes the wrench of the invention unique from all other bushing wrenches of prior art and from those available in commerce today. Essentially, this device incorporates the use of an ejection plunger assembly (3, 4, 5) to facilitate the reception and retention of said recoil spring plunger (7) until the operator is ready to release the spring plunger (7) from the confines of receiving recess (12) by compression of reciprocating ejection plunger assembly (3, 4, 5), which will then allow the operator to rotate barrel bushing (8) to its closed position (FIG. 5). At which time, barrel bushing (8) will retain spring plunger (7).

Operation of the Device (1) Removal of Barrel Bushing, Recoil Spring and Spring Plunger The operator places bushing portion (2) of bushing wrench (1) over the installed barrel bushing (8) of a 1911-style pistol (FIGS. 7 and 10). This is done in a conventional and intuitive manner by the operator while gripping the bushing wrench (1) in one hand and the 1911-style pistol slide (10) in the other hand.

Bushing wrench (1) when engaged around barrel bushing (8) (FIG. 10) is pressed perpendicularly to the linear axis of the pistol, flat against the pistol's slide (10). The enclosed base of bushing wrench (1) will compress spring plunger (7) into and flush with pistol slide (10). With the recoil spring plunger (7) compressed, the barrel bushing (8) is now free and able to rotate clockwise in a plane perpendicular to the pistol slide (10).

The operator will now rotate the barrel bushing (8) clockwise until such rotation allows the recoil spring and spring plunger (7) to decompress by way of, and into receiving recess (12). The receiving recess (12) is placed in such a manner with said bushing wrench (1) so as to coincide with the rotatably-timed release of spring plunger (7) from the retention capacity of barrel bushing (8) (FIG. 9). The subsequent decompression of the recoil spring contained under spring plunger (7) causes recoil spring plunger (7) to travel a short distance, parallel with the axis of pistols slide (10), into receiving recess (12) of bushing wrench (1) (FIG. 9).

As recoil spring plunger (7) protrudes into receiving recess (12), reciprocating ejection plunger assembly (3, 4, 5) contained within, is concurrently being held rearward in the "receiving position" by the bias caused by ejector plunger spring (5). This condition creates the receiving recess (12), thus allowing the terminal portion of spring plunger (7) to be received within receiving recess (12) at the time of release from barrel bushing (8).

When recoil plunger (7) reaches the end of its travel into receiving recess (12), an audible click is heard by the operator. This audible click is caused by the shoulder of spring plunger (7) stopping against the bottom face of bushing wrench (1). This audible click informs the operator that bushing wrench (1) has properly received spring plunger (7) into receiving recess (12), and the operator may now safely control the decompression of spring plunger (7) (FIG. 9). At this time, the operator lifts the face of bushing wrench (1) away from pistol slide assembly (8, 9, 10) in a direction parallel with pistol slide (10), thus allowing spring plunger (7) to decompress in a controlled manner (FIG. 8). The pistol may now be further disassembled.

(2) Installation of Barrel Bushing, Recoil Spring and Spring Plunger

The operator will first assemble the 1911-style pistol in the conventional manner, with the recoil spring protruding from the end of pistol slide (10) in a decompressed state.

The recoil spring plunger (7) is now placed over the end of the recoil spring in the traditional manner (FIG. 8). The operator is now ready to install the recoil spring and spring plunger (7) into pistol slide (10) by way of compression.

The operator will first place the front tip, also referred to as the terminal portion, of the spring plunger (7) (FIG. 8) into the receiving recess (12) of the wrench (1) (FIG. 9).

While grasping pistol slide (10) in one hand and simultaneously gripping wrench (1) in the other, the operator compresses the recoil spring and spring plunger (7) into pistol slide (10) by way of pressing down on the wrench (1), in a manner that will maintain the needed alignment for successful retention (FIGS. 8 and 9).

As the operator reaches the end of assembly, compression of the recoil spring and spring plunger (7) will orientate bushing wrench opening (2) of bushing wrench (1) to coincide with barrel bushing (8) presently installed in pistol slide (10) (FIG. 10).

Once bushing wrench opening (2) is placed around barrel bushing (8), bushing wrench (1) will now rest against the face of pistol slide (10) (FIG. 10). At this time, the operator will place their thumb or finger against the top of the reciprocating ejection plunger actuator pad (3), and the operator will press the reciprocating ejection plunger assembly (3, 4, 5) inwardly to its "ejection position" (FIGS. 4 and 15), causing the subsequent compression of ejector plunger spring (5) and the inward movement of ejection plunger (4).

When the operator has fully compressed reciprocating ejection plunger assembly (3, 4, 5) to its furthest inward position, the tip or terminal portion of spring plunger (7) is fully ejected from the confines of the receiving recess (12). The spring plunger (7) is now resting below the radial plane of barrel bushing (8) and the face of bushing wrench (1).

The while maintaining downward pressure, the operator is now able to freely rotate barrel bushing (8) by way of bushing wrench (1) counter clockwise to its fully locked position (FIG. 5).

At this time, the operator will release spring plunger (7) into barrel bushing (8) retaining lip, which will now retain spring plunger (7) (FIGS. 5 and 7). This completes the assembly function of the bushing wrench (1).

The foregoing is considered illustrative of the principles of the invention. As modifications and changes may occur to those skilled in the art, it is not desired to limit the invention to the exact construction and manner of use as shown and described. Rather, all suitable modifications and equivalents may be resorted to as falling within the scope of the invention as claimed.

What is claimed is:

1. A bushing wrench for use with a handgun having a barrel, a recoil spring and associated spring plug adjacent the barrel, and a barrel bushing retaining the spring plug, the bushing wrench comprising:

a wrench body having an opening corresponding to the shape of the barrel bushing of the handgun; and an ejection plunger assembly located proximate to said opening;

wherein said ejection plunger assembly comprises a spring and first and second parts detachably engaged to each other.

2. The bushing wrench according to claim 1, wherein said ejection plunger assembly comprises an ejection plunger.

3. The bushing wrench according to claim 2, wherein said spring is configured to bias said ejection plunger in said wrench body.

4. The bushing wrench according to claim 1, wherein said first and second parts are snap-fitted to each other.

5. The bushing wrench according to claim 1, wherein said first and second parts are threadably engaged with each other.

6. The bushing wrench according to claim 1, wherein said wrench body is manufactured from a material selected from the group consisting of stock aluminum alloy, steel, a ceramic, and a rigid polymeric material.

7. The bushing wrench according to claim 1, wherein the first and second parts of the ejection plunger assembly are manufactured from a material selected from the group consisting of aluminum, steel, a ceramic, and a polymeric material.

8. The bushing wrench according to claim 1, wherein the spring biases the ejection plunger assembly in said wrench body.

9. The bushing wrench according to claim 1, wherein release of the ejection plunger assembly creates a receiving recess in the wrench.

10. The bushing wrench according to claim 1, wherein said first part is an actuator pad and said second part is an ejection plunger.

11. A method of partially assembling and disassembling a pistol using the bushing wrench of claim 1.

12. A bushing wrench for use with a handgun having a barrel, a recoil spring and associated spring plug adjacent the barrel, and a barrel bushing retaining the spring plug, the bushing wrench comprising:

a wrench body having an opening corresponding to the shape of the barrel bushing of the handgun;

an ejection plunger located proximate to said opening;

and a spring received within said ejection plunger.

13. The bushing wrench according to claim 12, further comprising a retention pin.

14. The bushing wrench according to claim 12, wherein the retention pin is disposed in a retention receiving channel.

15. The bushing wrench according to claim 12, wherein said ejection plunger is received within a circular recess.

16. The bushing wrench according to claim 15, comprising a means to selectively contain and control said ejection plunger within said circular recess.

17. The bushing wrench according to claim 15, comprising a means to selectively release said ejection plunger contained within said circular recess.

18. The bushing wrench according to claim 12, wherein said spring is configured to bias said ejection plunger in said wrench body.

* * * * *